US010945576B1

(12) United States Patent
Seliga

(10) Patent No.: US 10,945,576 B1
(45) Date of Patent: Mar. 16, 2021

(54) FLOATING HANDLE

(71) Applicant: James Seliga, Bellevue, OH (US)

(72) Inventor: James Seliga, Bellevue, OH (US)

( * ) Notice: Subject to any disclaimer, the term of this patent is extended or adjusted under 35 U.S.C. 154(b) by 262 days.

(21) Appl. No.: 16/150,425

(22) Filed: Oct. 3, 2018

Related U.S. Application Data

(60) Provisional application No. 62/569,875, filed on Oct. 9, 2017.

(51) Int. Cl.

| | |
|---|---|
| ***A47L 9/32*** | (2006.01) |
| ***B25G 1/10*** | (2006.01) |
| ***A47L 9/24*** | (2006.01) |
| ***B08B 5/04*** | (2006.01) |
| ***A47L 9/06*** | (2006.01) |

(52) U.S. Cl.
CPC ..... *A47L 9/327* (2013.01); *A47L 9/0693* (2013.01); *A47L 9/248* (2013.01); *B08B 5/04* (2013.01); *B25G 1/10* (2013.01)

(58) Field of Classification Search
CPC ..... A47L 9/327; A47L 9/0693; A47L 9/248; B25G 1/10; B08B 5/04
See application file for complete search history.

(56) References Cited

U.S. PATENT DOCUMENTS 3,618,157 A * 11/1971 Bassin ..... E01H 1/0836 15/330
6,226,833 B1 * 5/2001 Kawaguchi ..... A47L 5/14 15/405
8,056,180 B2 * 11/2011 Iacona ..... A01G 20/47 15/312.2
9,038,232 B1 * 5/2015 Morrow ..... A01G 20/47 15/300.1
9,204,774 B1 * 12/2015 Jackson ..... A47L 11/34
2005/0051583 A1 * 3/2005 Herzog ..... A01G 20/47 224/221
2006/0096135 A1 * 5/2006 Shaffer ..... B25F 5/026 37/244
2010/0146730 A1 * 6/2010 Iacona ..... A01G 20/47 15/405
2015/0237808 A1 * 8/2015 Prager ..... A47L 5/14 15/405
2016/0235012 A1 * 8/2016 Fears ..... A01G 20/43

* cited by examiner

*Primary Examiner* — David Redding
(74) *Attorney, Agent, or Firm* — Jerry Semer

(57) ABSTRACT

The invention is a floating handle system for a debris handling machine. The debris handling machine picks up leaves and debris along the roadside. The debris handling machine is comprised of a vacuum blower that sucks up leaves through a hose. Attached to the blower vacuum is a biasing system consisting of an L-shaped biasing piece that extends upward vertically from the blower vacuum and then horizontally in the plane of the hose. Attached to the distal end of the L-shaped piece is a biasing chain. The other end of the biasing chain is attached to the hose. The handle assembly is a front handle that is permanently attached to the distal end of the hose and a floating handle that can move over the hose from the front handle to the point at which the biasing chain is attached to the hose.

16 Claims, 2 Drawing Sheets

20
26
27
14
16
24
25
21
DETAIL A
SCALE 1/12

11
10
12
18
17
20
21
26
27
24
25
16
14
A

FLOATING HANDLE

FIELD OF INVENTION

The invention relates to a system for supporting and controlling the nozzle end of a high-pressure hose and more particularly to supporting and controlling the nozzle of a hose that is part of a debris handling machine, often referred to as a truck loader which is used to pick up leaves and debris along the roadside and discharge the leaves and debris into a truck bed.

BACKGROUND OF THE INVENTION

Machines are used pick up leaves and debris along the side of the road. These machines are called debris handling machines or truck loaders. These machines are comprised of a blower vacuum machine to which a long hose is attached. An operator guides the hose to pick up debris and leaves along the side of the road. The debris is sucked in by the blower vacuum machine and then is discharged through a chute into the bed of a truck.

These machines in their current design are cumbersome and not ergonomic. The hose designed to pick up leaves along the side of the road is difficult to maneuver and cumbersome. The hose is very heavy. Thus, an objective of this invention is to create a debris handling machine whose pickup hose is easy to handle and maneuverable. The inventor believes that the main problem with the prior art is the prior art's handle system is poorly designed. The handle system of the prior art is comprised of a bar attached to the nozzle of the hose that bends upward to a forward handle to be grasped usually by the handlers left hand, and then the bar extends backward towards a second handle usually gripped by the right hand. This system is unwieldy and gives the handler very little control over the nozzle of the hose.

Applicant redesigned handle system gives the user full control over the direction and the movement of the hose. The user of the applicant's system operates the hose with both hands. The user places one of his hands on the handle that attaches to the nozzle. He can use either his right hand or his left. Thus, whether one is right-handed or left-handed makes no difference in the use of the applicant's system. The other hand is placed on a floating handle further up the hose. The floating handle can be moved along the hose so that the applicant can place the handle in the best position for his control of the hose. The operator holds the floating handle while directing the hose toward the debris on the ground. Being able to support the hose independently makes the task much easier. With the floating handle, the operator can support the hose with one hand while with his other hand he moves the hose towards the debris. The inventor has further made the hose easier to handle by biasing the hose with a biasing chain that supports a large portion of the weight of the hose. The biasing system is a L-shaped piece with a chain. The biasing system is attached to the vacuum blower. The L-shaped piece extends upward from the vacuum blower and then horizontal in the plane of the hose. The horizontal portion of the L-shaped piece swings with the hose as the operator guides it. A chain is attached to the end of the L-shaped piece, and the distal end of the chain is attached to the hose. This supports a large portion of the hose's weight and makes it easier for the operator to maneuver the hose.

The floating handle makes it easier for the operator to handle the hose. The floating handle enables individuals of any size to be able to maneuver the hose in the optimal hand position. The ability to move the floating handle enables the operator an extra dimension of maneuverability. The operator can support the hose with one hand and maneuver it with the other.

SUMMARY OF THE INVENTION

The invention is a floating handle system for a debris managing machine also known as a truck loader. The debris handling machine picks up leaves and debris along the roadside and discharges them into a truck bed. The debris handling machine is comprised of a vacuum blower that sucks up leaves through a hose attached to one with ducts and discharges those leaves and debris into a truck bed via a duct and a chute. An individual directs the hose's nozzle towards leaves and debris on the ground.

The debris handling machine has a blower-vacuum with a duct extending from the blower vertically and then extends perpendicular. At the end of the duct is an opening. In the preferred embodiment, the blower-vacuum is attached to a truck, and this duck carries debris over a truck bed and dispels the debris into the bed.

A hose is attached to the center of the blower vacuum. The hose is designed to pick up leaves and debris along a roadside. Attached to the blower vacuum is a biasing system consisting of an L-shaped biasing piece that extends upward vertically from the blower vacuum and then horizontally in the plane of the hose. The horizontal portion of the L-shaped piece swings with the hose as the operator guides it. Attached to the distal end of the L-shaped piece is a biasing chain. The other end of the biasing chain is attached to the hose. The L-shaped biasing piece and the biasing chain are designed to support the hose and make it easier for the user to move with the hose close to the ground.

The invention is the handle assembly. The handle assembly is a front handle that is permanently attached to the distal end of the hose and a floating handle that can move over the hose from the front handle to the point at which the biasing chain attaches to the hose. The floating handle's design allows for much easier handling of the hose. To use the floating handle, the operator holds the floating handle while directing the hose toward the debris on the ground. The operator being able to support the hose independently makes the task much easier. The operator can support the hose due to the biasing system and the floating handle. By allowing the floating handle to move along the hose, the operator can maneuver the hose in different directions easily. The advantage of the system is that the operator holds the floating handle with one arm, supporting most of the weight of the hose, and with the other arm moves the front handle guiding the nozzle of hose in any direction easily.

DETAILED DESCRIPTION OF THE PREFERRED EMBODIMENT

Figure 1:
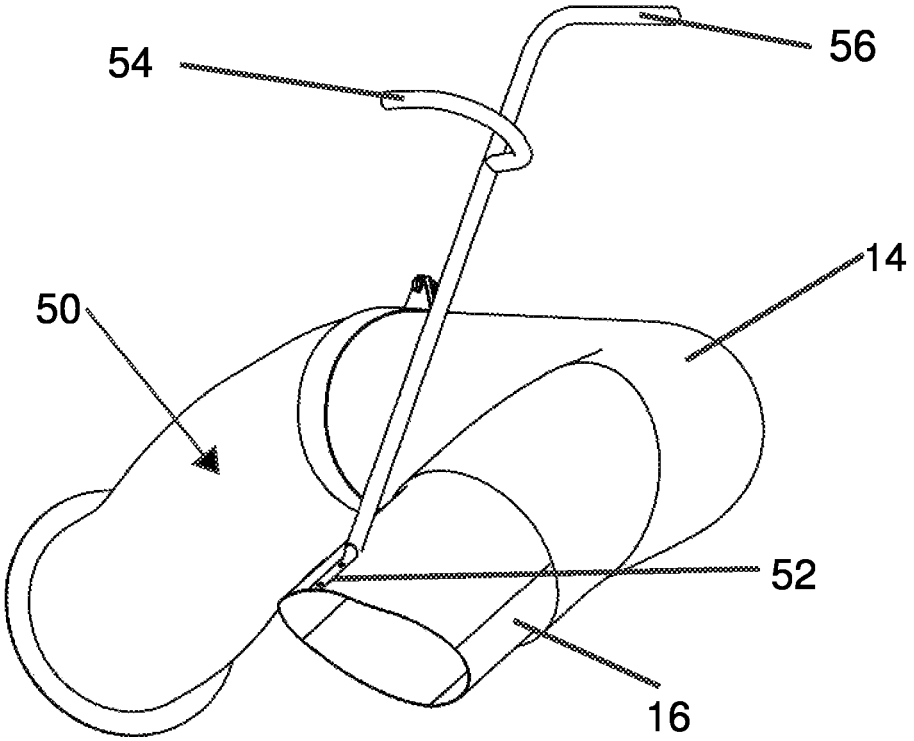
FIG. 1 is a view of the prior art.

FIG. 1 is a picture of the prior art handle system 50. In the prior art, one end of a hose 14 is attached blower vacuum 10. A bar 52 is attached to nozzle 16 at the opposite end of the hose 14. That end of the hose 14 is used to pick up debris and leaves from a roadbed. The bar 52 attached to the nozzle 16 of the hose 14. The bar 52 follow the hose 14 for a short distance than bends upward to a first handle 54. In FIG. 1, the first handle 54 is to be grasped by the operators left hand. In FIG. 1 the handle system 50 has been designed for a right-handed person. However, the handle system 50 could be designed for a left-handed person by placing the first handle on the other side of the hose 14 which would allow a left handed person to grasp the first handle with his right hand. The bar 52 then extend further away from the hose 14 to the second handle 56 which in FIG. 1 is gripped by the right hand. The two handles 54 and 56 are attached together which means that the movement of one handle causes the movement of the other. Also, the weight of the hose falls upon both handles 54 and 56 making this system is unwieldy and gives the handler very little control over the nozzle 16 of the hose 14.

Figures 2, 3:
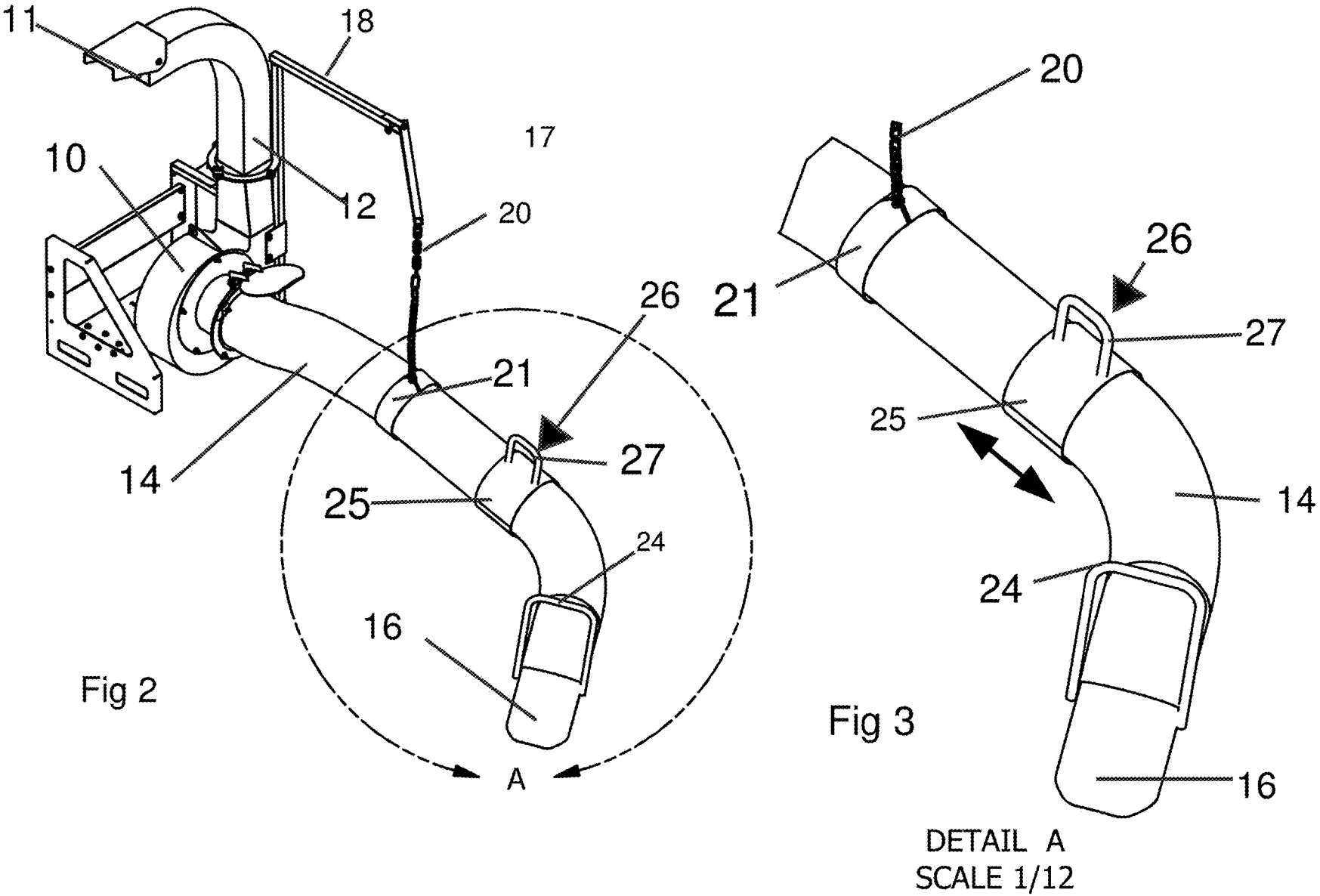
FIG. 2 is a perspective view of a hose assembly with, the invention attached.
FIG. 3 is the circle section A of FIG. 2.

FIG. 2 is a perspective view of a hose assembly with, the invention attached. FIG. 2 shows the blower-vacuum 10. Blower vacuum 10 has a tangential duct 12 that extends from the blower vacuum 10 vertically. The tangential duct 12 extends upward and then extends perpendicular. At the end of tangential duct 12 is an opening 11. In the preferred embodiment, the blower-vacuum 10 is attached to a truck (not shown), and the tangential duct 12 carries debris over a truck bed and dispels the debris to the bed.

A hose 14 is attached to the center of the blower vacuum 10. The hose 14 is designed to pick up leaves and debris along a roadside. The nozzle end 16 of the hose 14 is cut at an angle to facilitate the movement of the hose 14 near the ground to pick up debris and leaves.

Attached to the blower vacuum 10 is a biasing system 17 consisting of an L-shaped biasing piece 18 that extends upward vertically from the blower vacuum 10 and then horizontally in the plane of the hose 14. The horizontal portion of the L-shaped piece 18 swings with the hose 14 as the operator guides it. Attached to the distal end of the L-shaped piece 18 is a biasing chain 20. The other end of biasing chain 20 is attached to the hose 14. Biasing chain 20 is attached to hose 14 by the biasing chain 20 being attached to collar 21 around hose 14. The L-shaped biasing piece 18 and the biasing chain 20 are designed to support the hose 14 and make it easier for the user to move with the hose 14 close to the ground.

The invention is the handle assembly. The handle assembly is comprised of the front handle 24 that is permanently attached to nozzle 16, the distal end of the hose 14 and a floating handle 26 that can move over the hose from the front handle 24 to the point at which the biasing chain 20 attaches to the hose 14. As stated above the nozzle's end 16 of hose 14 is cut at an angle to facilitate the movement of the hose 14 near the ground. In the preferred embodiment, front handle 24 is formed by an inverted U-shaped piece fitting over the hose. The front handle 24 is nearly perpendicular to the ground and thus at an angle to the nozzle end 16 to allow the operator to hold the handle 24 and keep the nozzle 16 parallel to the ground.

The floating handle 26 is formed by a piece of material 25 that wraps around the hose 16 and whose inner diameter is slightly larger than the outer diameter of hose 14. In the preferred embodiment, the piece of material 25 is formed by two semicircular pieces of material. This enables floating handle 26 to be able to move over hose 14. On the top of the pieces of material 25, an inverted U-shaped bar 27 is attached to form a grip. The U-shaped bar 27 is attached in line with hose 14 to enable the U-shaped bar 27 to be easily gripped by the operator. The floating handle 26 is designed to be both easily gripped and moved by the operator.

The floating handle 26 has many advantages over the prior art. The floating handle's 26 design allows for much easier handling of the hose. To use the floating handle 26, the operator holds floating handle 26 while directing the hose 14 toward the debris on the ground. The operator can support the hose 14 due to the biasing system 17 and the floating handle 26. The operator being able to independently support the hose 14 with floating handle 26 makes the task much easier. As pointed out above in the prior art, the two handles 54 and 56 are attached together, and thus the operator must support the weight of the hose 14 with both hands which make it difficult to maneuver. By allowing the floating handle 26 to move along the hose 14, the operator can maneuver the hose 14 in different directions easily.

FIG. 3 is the circle section A of FIG. 2. FIG. 3 shows the floating handle 26 between the nozzle 16 of the hose 14 and the point at which biasing chain 20 attaches to hose 14. FIG. 3 also shows that the floating handle 26 can be moved between the nozzle 16 and the point at which biasing chain 20 attaches to hose 14. The operator holds floating handle 26 with one arm and with the other arm moves the front handle 24 moving the nozzle 16 of hose 14. The front handle 24 can move the nozzle 16 of hose 14 in either direction along the ground. The advantage of the system is that the operator holds floating handle 26 with one arm, supporting most of the weight of the hose. The other arm, with little of the hose's 14 weight, can easily guide the nozzle 16 with the front handle 24 in any direction.

I claim:

1. A debris handling machine comprising:

a) a blower-vacuum; and, b) a hose with a distal end that is guided by an operator and an outer diameter, attached to the blower-vacuum that expels pressurized air when the blower-vacuum is being operated as a blower and pulls air and debris into the hose when the blower-vacuum is operated as a vacuum; and, c) a duct attached to the blower-vacuum that expels the debris pulled into the hose; and, d) a handle assembly comprising;

1) a front handle that is permanently attached to the distal end of the hose; and, 2) a floating handle that can move over the hose.

2. A debris handling machine as in claim 1 comprising:

a) a biasing system designed to support the hose and make it easier for an operator to move the hose.

3. A debris handling machine as in claim 2 wherein:

a) the biasing system comprises:

1) an L-shaped biasing piece with a vertical portion that extends upward from the blower vacuum and a horizontal portion with a distal end that extends horizontally in the plane of the hose; and, 2) the horizontal portion of the L-shaped piece swings with the hose as it is guided by the operator; and, 3) a biasing chain with a distal end attached to the distal end of the horizontal portion of the L-shaped piece; and, 4) the distal end of the biasing chain attaches to the hose.

4. A debris handling machine as in claim 3 wherein:

a) the floating handle that can move over the hose from the front handle to where the biasing chain attaches to the hose.

5. A debris handling machine as in claim 1 wherein:

a) the hose has a nozzle attached to its distal end.

6. A debris handling machine as in claim 5 wherein:

a) the nozzle is cut at an angle.

7. A debris handling machine as in claim 1 wherein:

a) the front handle is formed by an inverted U-shaped piece fit over the hose.

8. A debris handling machine as in claim 4 wherein:

a) the floating handle comprises;

1) a ring piece that encircles the hose and can be moved along the hose; and, 2) a handle attached to the ring piece.

9. A debris handling machine as in claim 8 wherein:

a) the handle of the floating handle is a U-shaped bar that attaches to the ring piece whose top is parallel with the hose.

10. A debris handling machine as in claim 1 wherein;

a) the debris handling machine is attached to a truck with a truck bed; and, b) the duct attached to the blower-vacuum that expels the debris pulled into the hose is L-shaped and of a height that it will be able to expel debris into the truck bed.

11. A debris handling machine as in claim 10 wherein;

a) the duct is tangentially attached to the vacuum blower.

12. A debris handling machine as in claim 3 wherein;

a) the biasing system enables an operator to support the hose with only the floating handle.

13. A debris handling machine as in claim 7 wherein;

a) the front handle is attached to hose at an angle nearly perpendicular to the ground when the nozzle's end is parallel to the ground.

14. A debris handling machine as in claim 3 wherein:

a) the front handle is formed by an inverted U-shaped piece fit over the hose.

15. A debris handling machine as in claim 14 wherein;

a) the front handle is attached to hose at an angle nearly perpendicular to the ground when the nozzle's end is parallel to the ground.

16. A debris handling machine as in claim 3 wherein;

a) the debris handling machine is attached to a truck with a truck bed; and, b) the duct attached to the blower-vacuum that expels the debris pulled into the hose is L-shaped and of a height that it will be able to expel debris into the truck bed.

* * * * *